US008371190B2

(12) United States Patent
Miller

(10) Patent No.: US 8,371,190 B2
(45) Date of Patent: Feb. 12, 2013

(54) FINGERTIP TOOL HOLDER

(76) Inventor: Asaf Miller, Hadera (IL)

( * ) Notice: Subject to any disclaimer, the term of this patent is extended or adjusted under 35 U.S.C. 154(b) by 467 days.

(21) Appl. No.: 12/612,703

(22) Filed: Nov. 5, 2009

(65) Prior Publication Data

US 2010/0107827 A1 May 6, 2010

Related U.S. Application Data

(60) Provisional application No. 61/111,740, filed on Nov. 6, 2008.

(51) Int. Cl.
*B25B 23/16* (2006.01)

(52) U.S. Cl. ..... 81/177.3; 81/60; 81/436; 294/25

(58) Field of Classification Search ..... 81/60, 124.4, 81/177.1–177.85, 429–462, 212.1
See application file for complete search history.

(56) References Cited

U.S. PATENT DOCUMENTS

| | | | | |
|---|---|---|---|---|
| 226,582 | A * | 4/1880 | Miller | 81/124.4 |
| 1,239,131 | A * | 9/1917 | Shay | 81/439 |
| 1,902,453 | A * | 3/1933 | Kaiser | 294/25 |
| 2,418,638 | A * | 4/1947 | Hoover | 81/177.3 |
| 2,788,817 | A | 4/1957 | Leniz | |
| 2,891,434 | A | 6/1959 | Lozensky | |
| 3,913,646 | A * | 10/1975 | Grayson | 81/44 |
| 4,791,837 | A * | 12/1988 | Main | 81/63.1 |
| 5,086,674 | A * | 2/1992 | Her | 81/124.4 |
| 6,332,888 | B1 * | 12/2001 | Levy et al. | 606/144 |
| 6,834,570 | B2 * | 12/2004 | Risolio | 81/177.3 |
| 2003/0061914 | A1 | 4/2003 | Benatz | |
| 2007/0028727 | A1 * | 2/2007 | Schiller | 81/177.3 |
| 2007/0044599 | A1 * | 3/2007 | Hsieh | 81/177.85 |
| 2009/0139378 | A1 * | 6/2009 | Chiang et al. | 81/438 |
| 2009/0152150 | A1 | 6/2009 | Kernoodle, Jr. | |

FOREIGN PATENT DOCUMENTS

| | | |
|---|---|---|
| CH | 439171 A | 6/1967 |
| DE | 29615765 U1 | 10/1996 |
| GB | 564439 A | 9/1944 |

* cited by examiner

*Primary Examiner* — Monica Carter
*Assistant Examiner* — Melanie Alexander
(74) *Attorney, Agent, or Firm* — Deborah Gador

(57) ABSTRACT

The present invention relates to a tool holder for holding tools by means of a magnet, which includes a finger socket permitting the tool holder to be mounted on a fingertip for manipulating tool bits or other accessories. The tool holder includes a finger socket and a tool holding portion coupled to the finger socket. The tool holding portion is at least partially formed of material having magnetic properties. Preferably, the magnetic tool holder may include a bit wrench, a socket wrench, screw bits or an element holder.

19 Claims, 9 Drawing Sheets

FINGERTIP TOOL HOLDER

FIELD OF THE INVENTION

The present invention relates to tool holders, in general and, in particular, to tool holders which are held and manipulated on a finger tip.

BACKGROUND OF THE INVENTION

Finger-mounted tools and tool holders are known in the art for use in areas which are difficult to access. U.S. Pat. No. 2,585,641 to Faso describes tools, such as wrenches, screwdrivers, etc., which include a ferrule for mounting on the top portion of a finger. U.S. Pat. No. 6,834,570 to Risolio describes a finger wrench that can be used to reach locations which can only be reached by fingers.

U.S. patent application 2006/0185057 to Terpinski describes a magnetic finger glove which helps to hold, install and retrieve small metallic objects, such as nuts or screws, in hard-to-reach places.

Accordingly, there is a long felt need for a tool holder for holding and manipulating mechanical tools, and it would be desirable to have such a tool holder which securely holds the tools for mounting on a finger.

SUMMARY OF THE INVENTION

There is provided, according to the present invention a tool holder. The tool holder includes a finger socket for mounting on a fingertip of a user, and a tool holding portion coupled to the finger socket. The tool holding portion is at least partially formed of material having magnetic properties.

According to one embodiment of the invention the tool holder of further includes a housing coupled to the finger socket and having a magnet disposed therein.

According to another embodiment of the invention the tool holding portion is integrally formed with the finger socket. Preferably, the tool holding portion includes a ratchet mechanism. The tool holding portion according to one embodiment is perpendicularly mounted on the finger socket. According to another embodiment, the tool holding portion is mounted in parallel to the finger socket.

The finger socket according to one embodiment includes a slit extending along the length of the finger socket. According to another embodiment the finger socket includes a finger adapter releasably disposed therein. Preferably, the finger adapter is selected from a plurality of finger adapters each having a different inner diameter.

According to one embodiment the tool holding portion is a wrench holder, which is preferably configured to snugly fit a wrench socket selected from a plurality of wrench sockets. According to another embodiment, the tool holding portion is configured for mounting an element holder thereon, and preferably includes a rotator for rotating the element holder. According to a further embodiment, the tool holding portion is an accessory holder.

There is further provided according to the present invention a tool holder kit including a tool holder as described above and a grip having a mounting portion for mounting the tool holder There is further provided according to the present invention a method for forming a tool holder. The method includes forming a finger socket for mounting on a fingertip of a user, coupling a tool holding portion to the finger socket, and forming at least a portion of the tool holding portion from a material having magnetic properties.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a tool holder for holding tools by means of a magnet, which includes a finger socket permitting the tool holder to be mounted on a fingertip for manipulating tool bits or other accessories. The tool holder includes a finger socket, and a tool holding portion coupled to the finger socket. The tool holding portion is at least partially formed of material having magnetic properties. The magnetic tool holder may include a bit wrench for holding tool bits, such screw bits, socket bits, etc. In another embodiment, the magnetic tool holder may hold accessories, such as a flashlight, knife, pen, clip, or a mini mirror, for using in hard-to-reach places. The term 'tool' in connection with the tool holder, for the purpose of the present application, refers to any hardware tools and accessories, including screw bits, socket bits, wrenches, element holders and the like or various accessories such as flash lights, laser tags, mini mirrors, knifes etc.

According to another embodiment of the invention, the tool holder includes a ratchet mechanism for providing unidirectional rotation of a tool bit by means of the tool held in the holder.

Figure 1A:
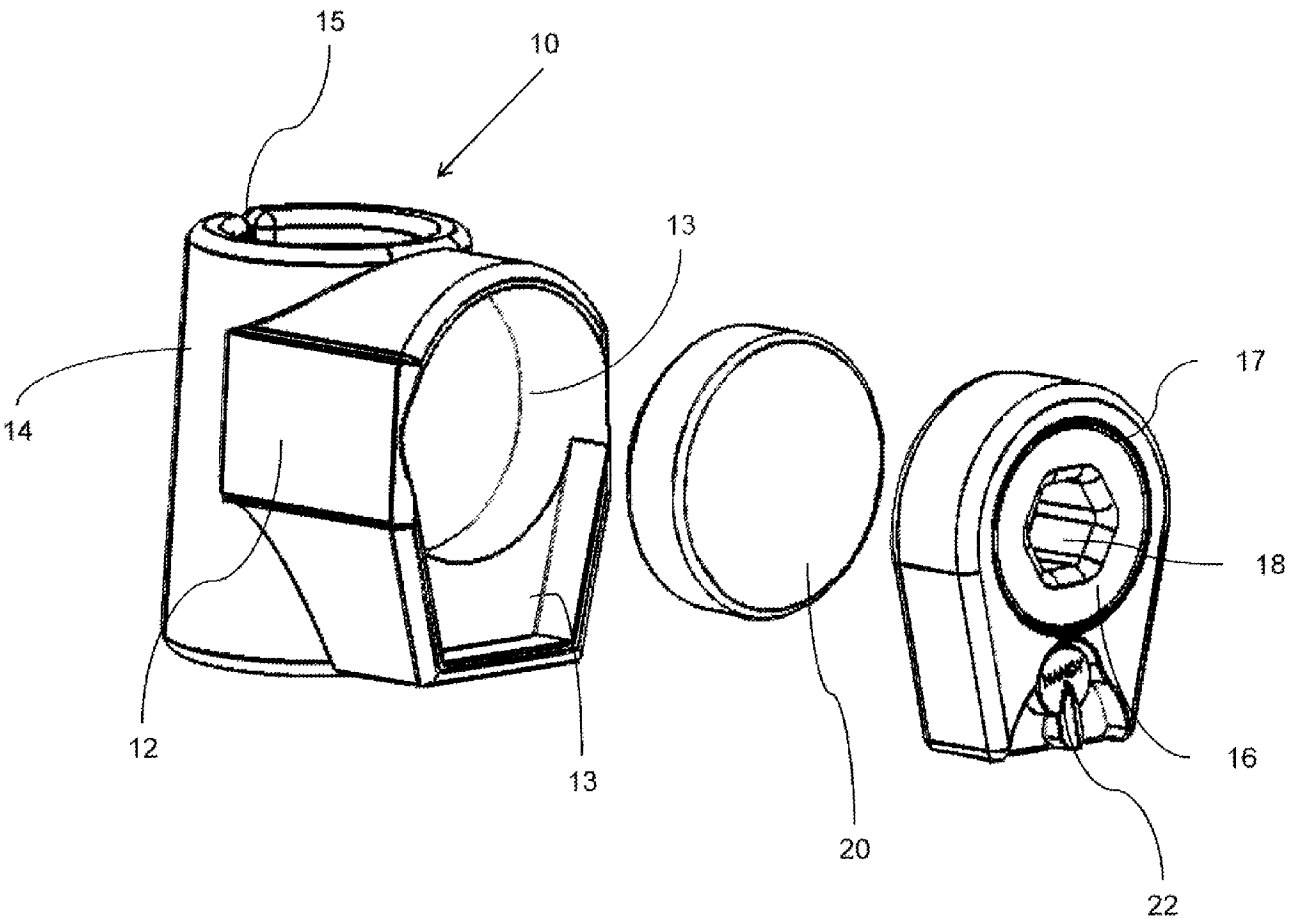
FIG. 1*a* is an exploded illustration of a finger-mounted tool holder, constructed and operative in accordance with one embodiment of the present invention.
Figure 1B:
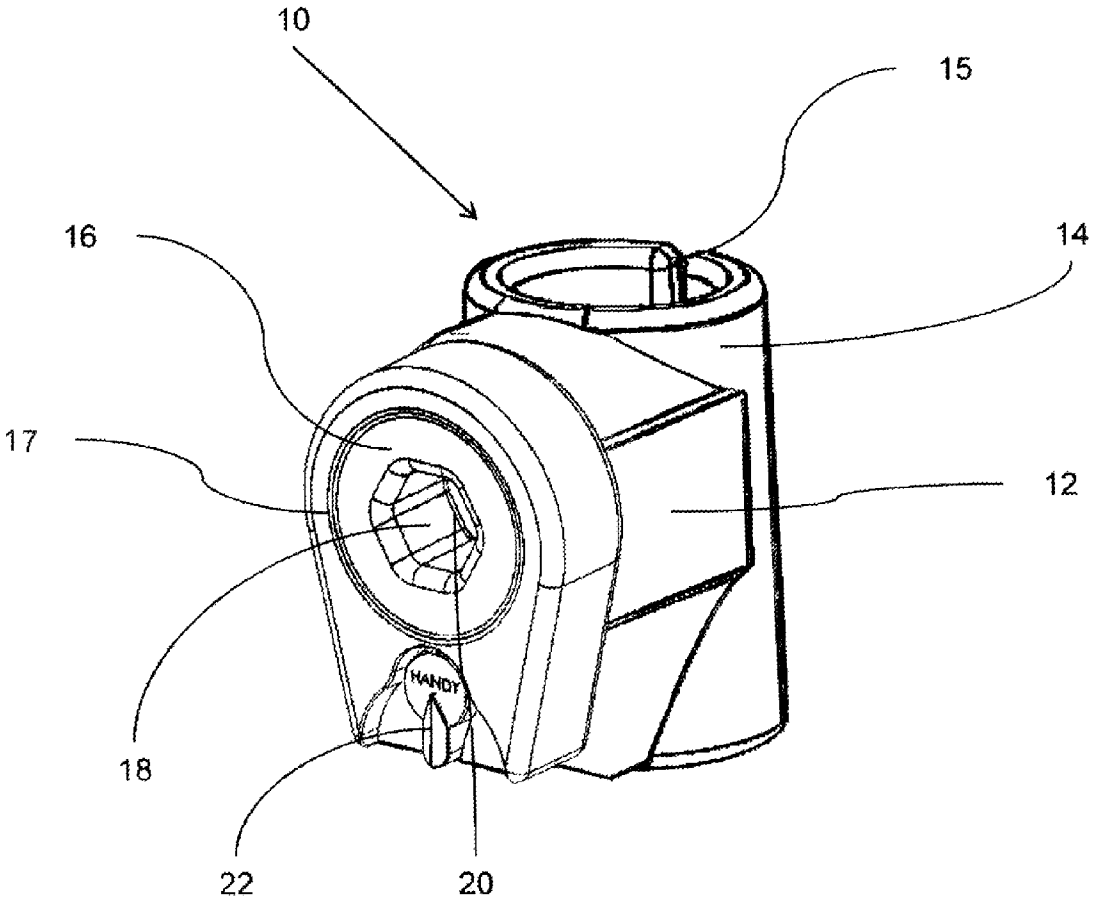
FIG. 1*b* is a perspective illustration of the tool holder of FIG. 1*a;*

Referring now to FIGS. 1*a* and 1*b*, there are shown exploded and perspective views of a finger-mounted tool holder 10, constructed and operative according to one embodiment of the present invention. Tool holder 10 includes a housing 12 coupled to a finger socket 14. Finger socket 14 is a hollow cylinder affixed to housing 12 for mounting on a fingertip. Preferably, finger socket 14 includes a slit 15, extending along the length of finger socket 14. Slit 15 allows the tool holder to be mounted on fingers of different diameters.

Housing 12 defines recesses 13, 13', for holding a magnet 20, and a tool holding portion 16 mounted substantially parallel to finger socket 14, respectively. Tool holding portion 16, which is coupled to housing 12, includes a socket 18 for receiving tool bits, such as screw bits or socket bits. Socket 18 is illustrated as being hexagonal in shape, although it can, alternatively, be of any other desired geometrical shape. The size of socket 18 is preferably a standard size, which fits standard tool bits. Tool holding portion 16 is mounted over magnet 20, holding the magnet in place inside recess 13. Magnet 20 holds the tool bits inserted in socket 18, preventing accidental release of the tool bit during use. Alternatively, magnet 20 can be eliminated and tool holding portion 16 may include a magnetic material.

In the illustrated embodiment, tool holding portion 16 is a ratchet screw driver, including a reversible ratchet wheel 17 with a pawl 22. The reversible ratchet wheel 17 allows the user to freely rotate tool holder 10 clockwise or counterclockwise about the axis of socket 18, while ratchet wheel 17 turns in only one direction, depending on the position of pawl 22.

The tool holder, according to the present invention, may be utilized to hold bits and allows the user mounting the finger tool on his finger to freely reach any hard-to-reach spot without fear of dropping the bit, and to easily rotate the bit using the reversible ratchet. According to this embodiment, the user uses his finger as a lever, creating torque.

According to another embodiment of the present invention, ratchet wheel 17 may be replaced with a non-rotating accessory holder and tool holder 10 may be arranged to hold a set of accessories, such as flashlight, mini mirror, knife, which are coupled to a base for insertion into socket 18. It will be appreciated that socket 18 and the base of the accessory bit may have any desired geometry, not necessarily hexagonal.

Figure 2:
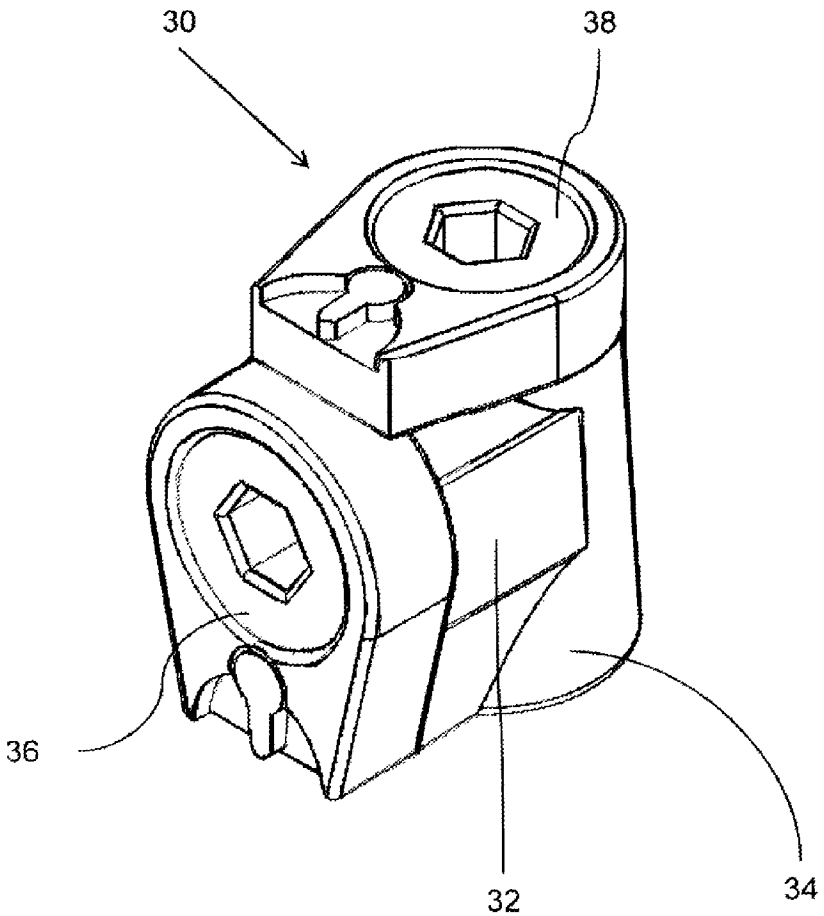
FIG. 2 is a schematic illustration of a finger-mounted tool holder, according to a second embodiment of the invention.

FIG. 2 is a perspective view of a finger mounted tool holder 30, according to another embodiment of the present invention. Tool holder 30 is substantially the same as tool holder 10 of FIG. 1 and includes a housing 32 defining a finger socket 34, and a tool holding portion 36 mounted in such away as to permit holding a tool perpendicularly to the user's finger during use. According to this embodiment, a second tool holding portion 38 is provided, mounted in such away as to permit holding a tool in parallel to the user's finger during use. Tool holding portion 38 also defines a recess for receiving a magnet (not shown). Tool holding portion 38 allows the user to rotate a tool bit by rotating his finger about its longitudinal axis. According to this embodiment, both parallel tool holding portion 36 and perpendicular tool holding portion 38 are provided with a magnet (not shown), for holding the tool bit in the tool holding portion, and a reversible ratchet wheel. It will be appreciated that, alternatively, tool holder 30 may be provided only with a perpendicularly mounted tool holding portion 38.

Figure 3:
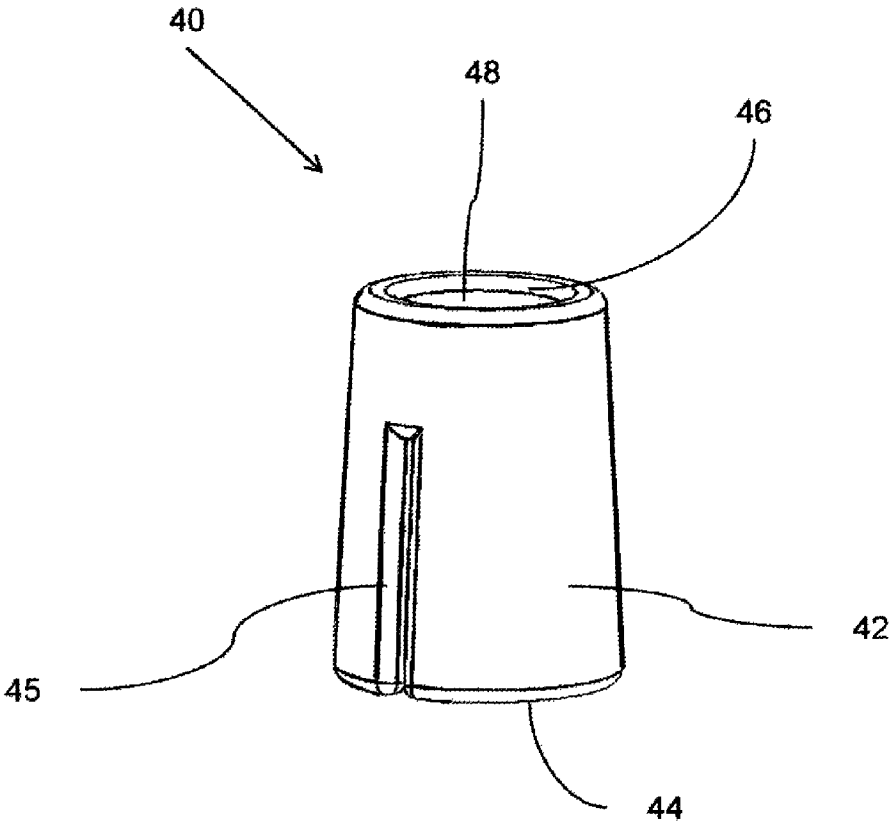
FIG. 3 is a schematic illustration of a finger-mounted tool holder, according to a third embodiment of the invention.

FIG. 3 is a perspective view of a tool holder 40, according to a further embodiment of the present invention. Tool holder 40 includes a finger socket 42, having an opening 44 at the wide end of the finger socket 42, for mounting on a fingertip. Finger socket 42 is a substantially conical in shape to hold a finger, and may be open at its top end. Preferably, finger socket 42 includes a slit 45, extending along the length of finger socket 42, for receiving fingers of different diameters. Preferably, the internal surface of finger socket 42 is rough or includes special elements for frictional or mechanical engagement of the finger. An accessory socket 46 is coupled to the narrow end of finger socket 44. Accessory socket 46, according to this embodiment, includes an annular aperture for receiving the base of an accessory, such as a flashlight or tool bits having an annular base. Alternatively, accessory socket 46 may have a different shape, such as hexagonal. Accessory socket 46 includes a magnet 48 for holding the base of the accessory firmly inside the socket. Alternatively, accessory socket 46, itself, can be magnetized.

Figure 4:
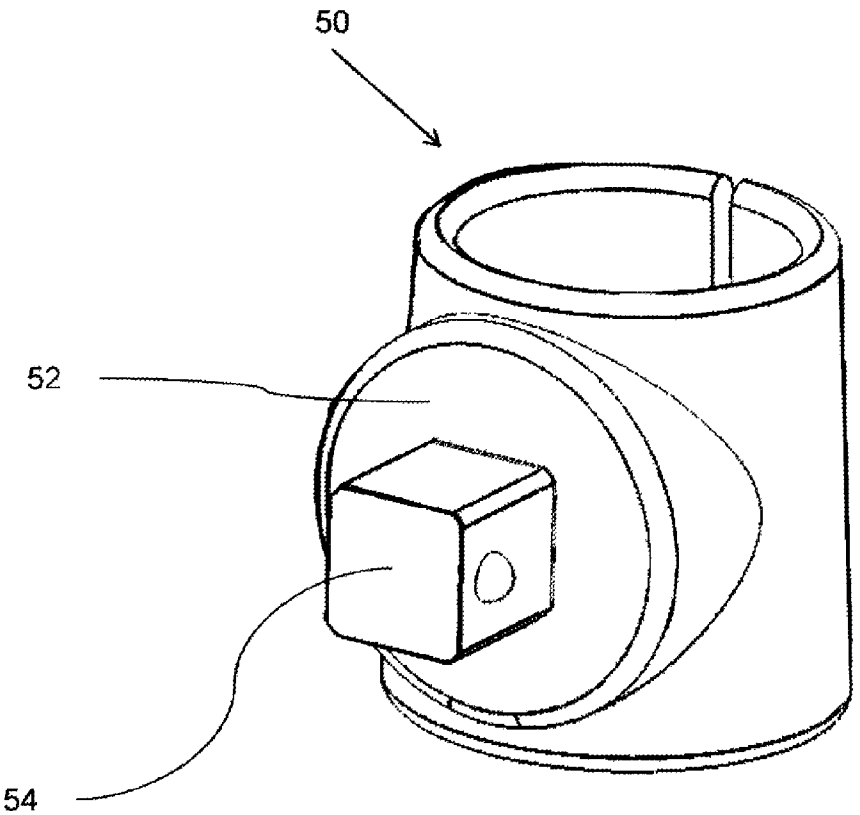
FIG. 4 is a perspective illustration of a finger-mounted tool holder, according to another embodiment of the invention.

According to a further embodiment of the invention, shown in FIG. 4, the tool holding portion 52 of a tool holder 50 may include a protruding element 54 for sitting inside a base of a tool or accessory to be manipulated (not shown). In this embodiment, the protruding element 54 may include a magnet or a magnetized portion, or a magnet may be held inside tool holding portion 52 and held in place by protruding element 54. It will be appreciated that the protruding element can be positioned substantially perpendicular to or substantially parallel to tool holder 50. A ratchet mechanism (not shown) may also be provided about protruding element 54, if desired.

It will be appreciated that the tool holder of the invention may include any combination of sockets, protrusions, and ratchet mechanisms, which can be mounted in parallel or perpendicular to the finger socket.

Figure 5B:
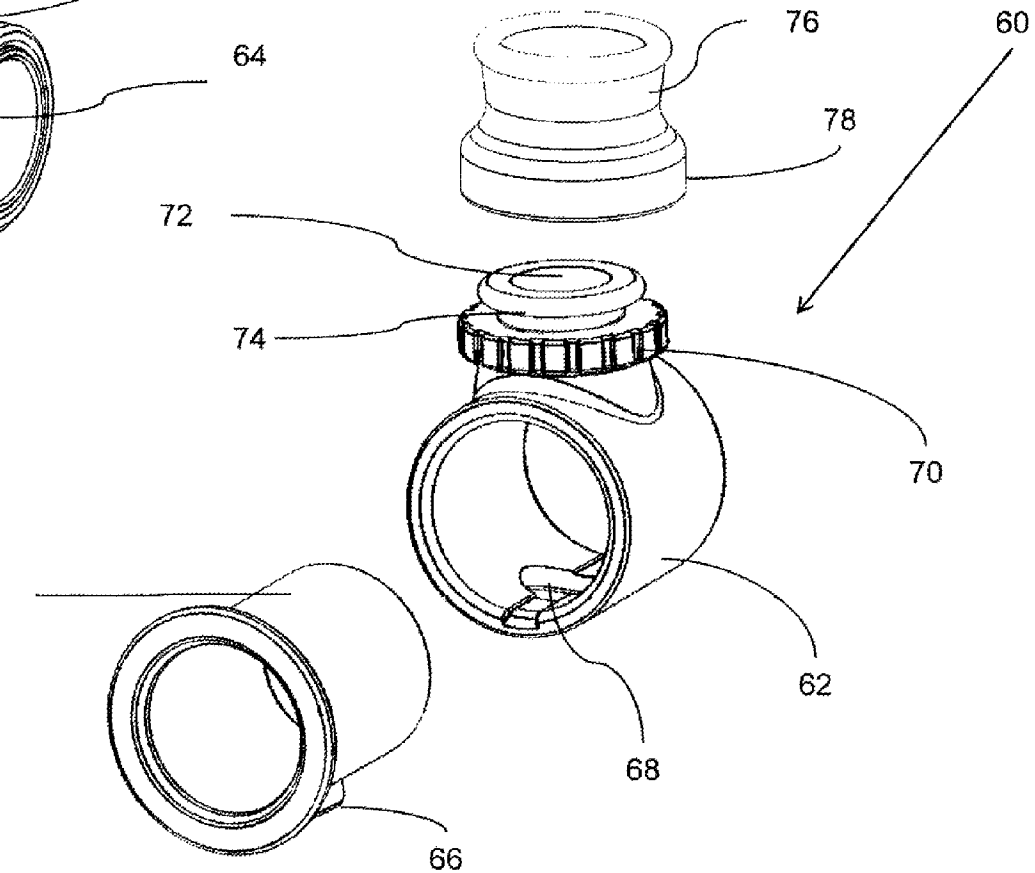
FIG. 5*b* is an exploded illustration of the element holder of FIG. 5*a;*
Figure 5A:
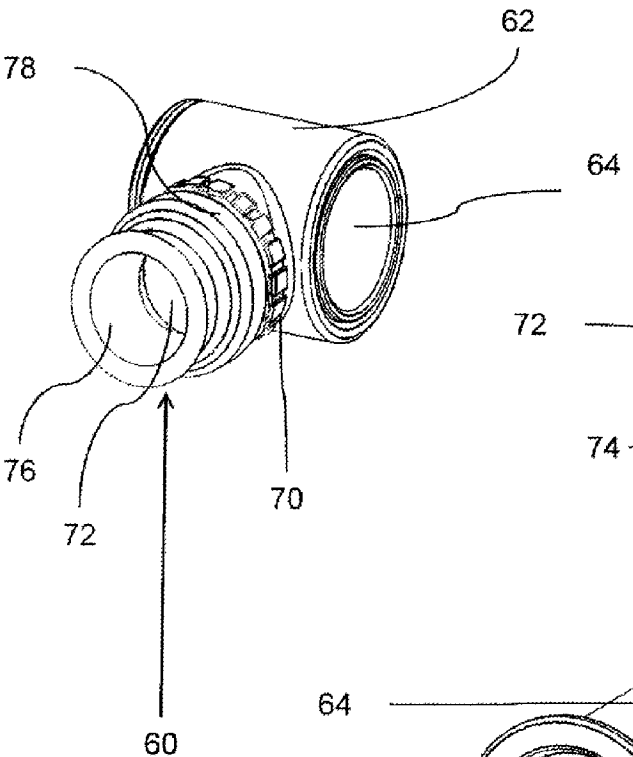
FIG. 5*a* is a schematic illustration of a finger-mounted element holder, constructed and operative in accordance with one embodiment of the present invention.

FIGS. 5*a* and 5*b* are a perspective view illustration, and an exploded view illustration, respectively, of a tool holder 60 constructed and operative in accordance with another embodiment of the present invention, and having an element holder mounted thereon. The term 'element' in connection with the element holder, for the purpose of the present application, refers to a variety elements, including screws, blots, nuts, screw nuts, flat washers, spring washers, anchors, screws, bolts, spacers, seal-rings, and the like. Tool holder 60 includes a finger socket 62 and a finger adapter 64 releasably disposed therein. Preferably, there may be provided a plurality of finger adapters 64 each having a different inner diameter for fitting the finger of a user. The user may mount in finger socket 62 finger adapter 64 which best fits his finger size. According to one embodiment, finger adapter 64 includes a mounting protrusion 66 for releasably securing finger adapter 64 inside finger socket 62. Accordingly, finger socket 62 includes a mounting aperture 68 for receiving mounting protrusion 66. Preferably, mounting protrusion 66 is made of an elastic depressable material allowing the user to press mounting protrusion 66 out of mounting aperture 68, and thus to remove finger adapter 64 from finger socket 62. Alternatively, mounting protrusion 66 may be provided with a retracting mechanism, such as a spring. It will be appreciated that finger socket 62 and finger adapter 64 may be provided with any one of a variety of known releasably securing arrangements. Preferably, the inner wall of finger adapter 64 is rough or includes special elements for frictional or mechanical engagement with the user's finger.

Figure 5D:
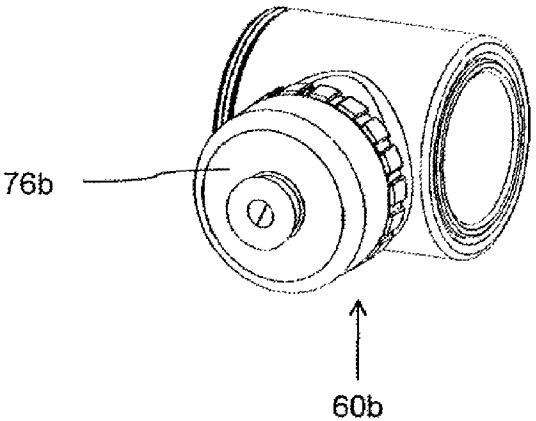
FIG. 5*d* is a perspective illustration of the element holder of FIG. 5*a* having a tool holder of a smaller diameter.
Figure 5C:
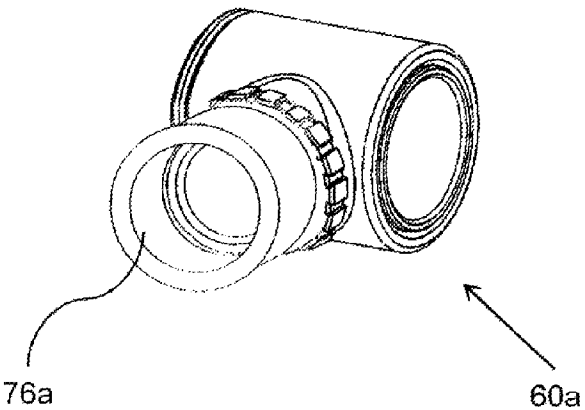
FIG. 5*c* is a perspective illustration of the element holder of FIG. 5*a* having a tool holder of larger diameter.

Tool holder 60 further includes a rotator 70 mounted on finger socket 62. Rotator 70 includes a magnet 72 mounted thereon, and is configured to for mounting an element holder 76 thereon Element holder 76 is adapted and configured to hold elements. Preferably, Rotator 70 further includes a mounting flange 74 for removably mounting thereon an element holder 76. Element holder 76 is sized and adapted to retain the bolt elements attached to magnet 72 in a desired sequence at a centrally aligned position. Preferably, element holder 76 is made of anelastic material which is capable of firmly holding elements having a peripheral diameter slightly larger than the inner diameter of element holder 76. Element holder 76 includes a mounting portion 78 adapted to removably engage mounting flange 74. Mounting portion 78 may be made of an elastic materiel so as to allow fairly easy removal of element holder 76 and replacing it with another. Preferably, mounting portion 78 is adapted to be snap-fitted or frictionally mounted on mounting flange 74. Alternatively, mounting portion 78 and mounting flange 74 may include mounting means for mounting element holder 76 on flange 74, such as a screw thread in the inner wall of mounting portion 78 and matching screw threads on the outer periphery of flange 74. Preferably, there may be provided a plurality of element holder 76 each having a different inner diameter for holding bolt elements of substantially the same peripheral diameter. The user may mount a element holder 76 having an inner diameter fitted to hold bolt elements of a desired peripheral diameter, such as element holder 76*a* of tool holder 60*a* having a larger diameter than element holder 76 as shown in FIG. 5*c* or element holder 76*b* of tool holder 60*b* having a smaller diameter than element holder 76 and 76*a* as shown in FIG. 5*d*.

The following is one example of a use of tool holder 60. Tool holder 60 may be utilized for mounting a washer and a screw nut on a hard to reach screw bolt. The user selects from a plurality of element holder 76 a sleeve having a diameter slightly larger than the peripheral diameter of the screw nut and washer and mounts same on flange. Then the user selects a finger adapter 64 which best fits the user's finger, slides same into finger socket 62 until mounting protrusion 66 enters a mounting aperture 68 so as to releasably secure finger adapter 64 inside finger socket 62. Then the user mounts tool holder 60 on his finger and disposes the screw nut first and then the washer into element holder 76 until the screw nut engages magnet 72 of rotator 70. It will be appreciated that the user may first select the finger adapter and then the sleeve or vise verse. It will be further appreciated that the screw nut on rotator 70 includes screw threads matching the screw threads of the screw bolt and washer comprises a central circular aperture having a diameter which is slightly larger than the diameter of the screw bolt. The washer and the screw nut, which are held by magnet 72, are retained by element holder 76 in substantially central alignment. The user then reaches out with his hand holding the element holder on his finger and inserts the hard to reach screw bolt into the opening of element holder 76 until the end of the screw bolt abuts the screw nut. Rotating rotator 70 by, for example, the user's other fingers, causes mounting of the washer and the screw nut onto the end of the screw bolt.

It will be appreciated that elements of various kinds may be held by the tool holder.

A portion of the outer periphery of rotator 70 may include engaging groves 71 for facilitating the turning of rotator 70.

Figure 6:
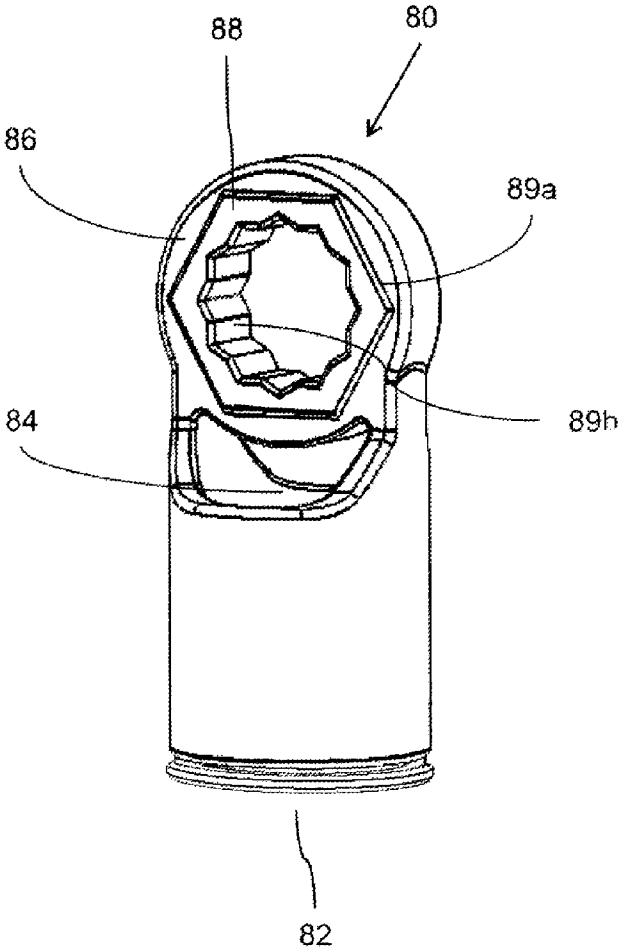
FIG. 6 is a schematic illustration of a finger-mounted wrench holder, constructed and operative in accordance with one embodiment of the present invention.

FIG. 6 is a perspective view illustration of a tool holder 80 constructed and operative in accordance with another embodiment of the present invention. Tool holder 80 includes a socket 82 and a finger adapter 84 constructed and operative substantially the same as finger socket 62 and finger adapter 64 as described above and illustrated in FIGS. 5*a*-5*b*. Tool holder 80 further includes a wrench holder 86 for holding a wrench socket 88 having an outer wall 89*a* and an inner wall 89*b* adapted and shaped to hold an element such as a screw nut or the head of a screw bolt. Outer wall 89*a* is adapted and configured to snugly engage wrench holder 86. Preferably, there may be provided a plurality of wrench sockets, each having an outer wall 89*a* adapted and configured to be snugly fitted in wrench holder 86, and an inner wall 89*b* of different shape and size so as to allow utilizing tool holder 80 with a variety of screws and bolts or other similar elements. It is a particular feature of the present invention that wrench holder 86 is formed of a magnetic material configured to retain a wrench socket seated therein.

Figure 7:
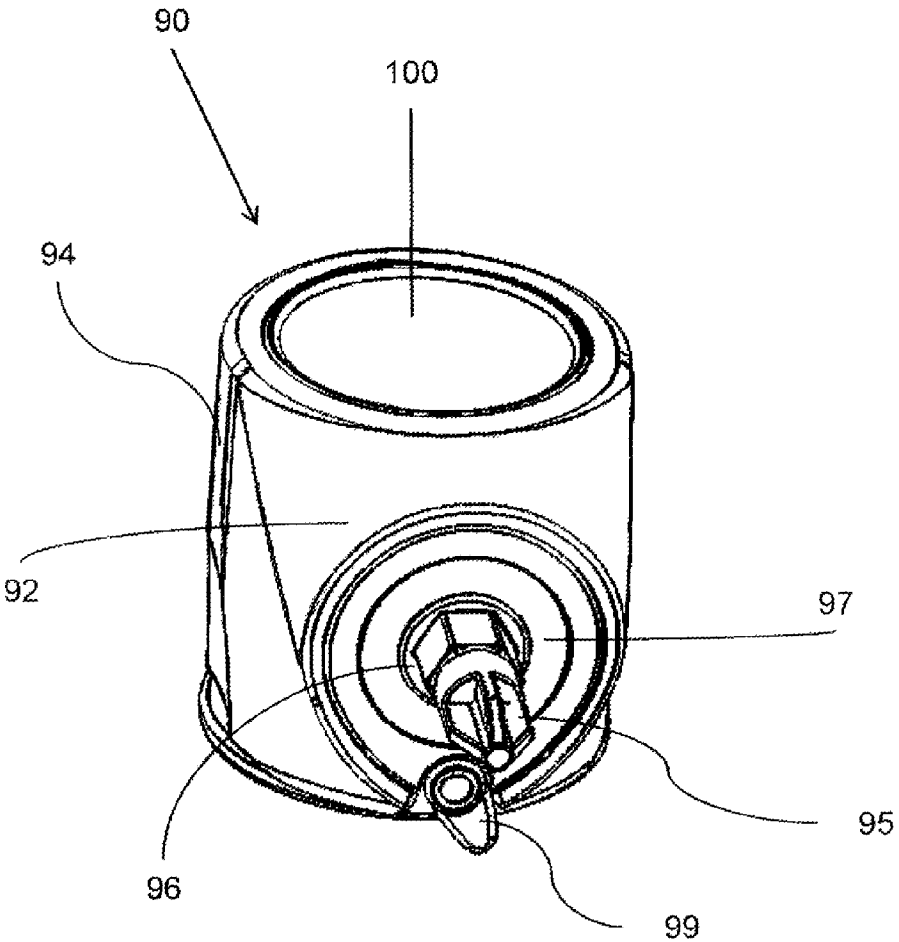
FIG. 7 is a perspective illustration of a finger-mounted tool holder, constructed and operative in accordance with another embodiment of the present invention.

FIG. 7 is a perspective view illustration of a tool holder 90 constructed and operative in accordance with another embodiment of the present invention. Tool holder 90 is substantially the same as tool holder 10 of FIG. 1*a* and includes a housing 92, a finger socket 94, and a tool holding portion 96 mounted on housing 92. Tool holding portion 96 includes a magnet, (not shown) and a reversible ratchet wheel 97 having a pawl 99. Tool holding portion 96 is shown here with a screw bit 95, seated therein and held by the magnet. Alternatively, other tool bit may be held in tool holding portion 96. According to this embodiment, finger socket 94 includes a finger adapter 100 substantially the same as finger adapter 64 of FIG. 5*a*.

Figure 8:
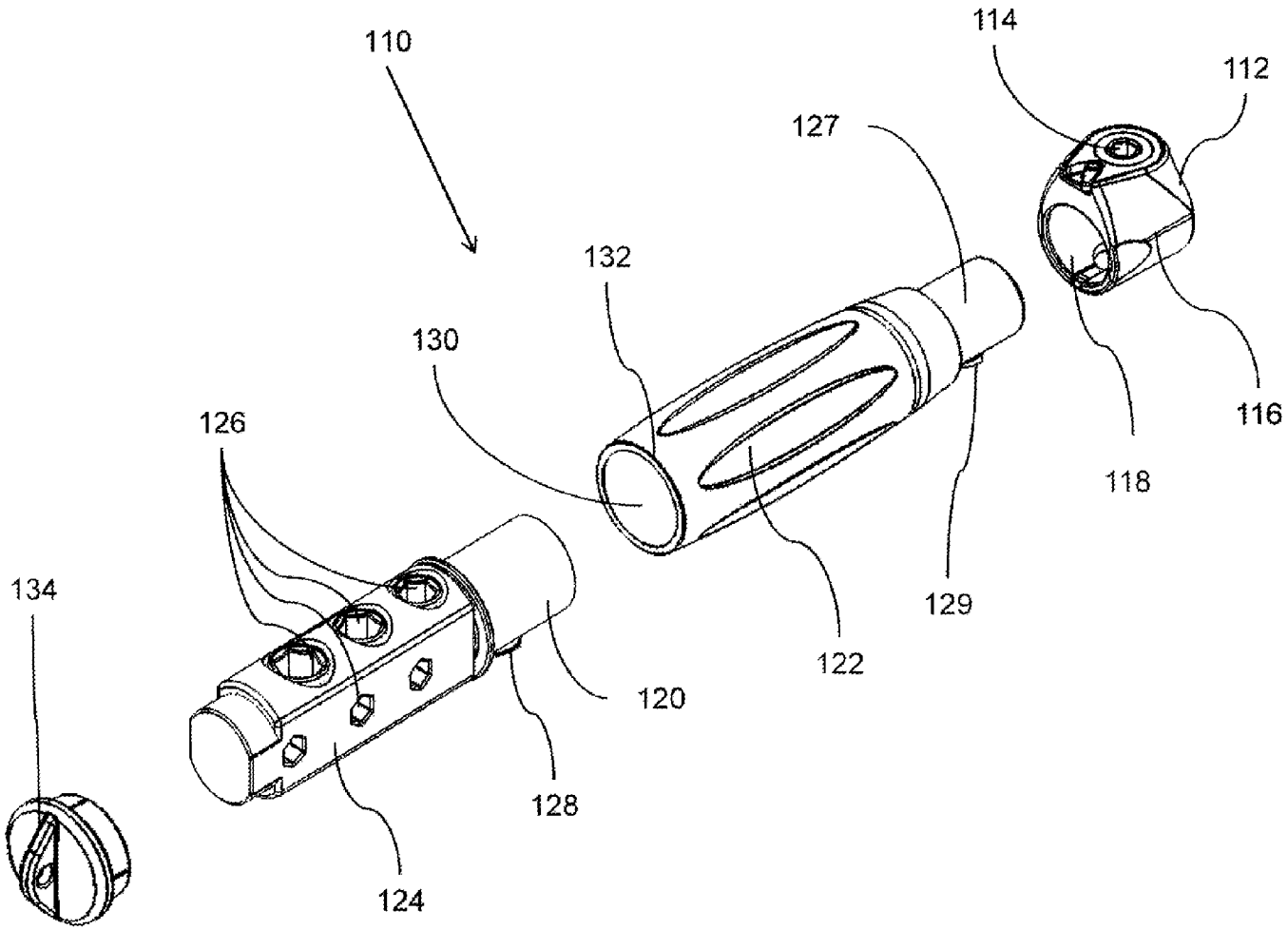
FIG. 8 is an exploded illustration of a tool holder kit, constructed and operative in accordance with one embodiment of the present invention.

FIG. 8 is an exploded view illustration of a tool holder kit 110 constructed and operative in accordance with another embodiment of the present invention. Tool holder kit 110 includes a tool holder 112, substantially the same as tool holder 90 of FIG. 7. Tool holder kit 110 further includes a tool holding portion 114, and a finger socket 116 having a mounting aperture 118. In addition, tool holder kit 110 includes at least one finger adapter 120, a grip 122, and a tool bits holder 124 and a plurality of tool bits 126 seated in tool bits holder 124. Finger adapter 120 is substantially the same as finger adapter 64 of FIG. 6*a* and includes a mounting protrusion 128. Grip 122 includes a mounting portion 127 adapted and configured to be mounted inside finger socket 116. Mounting portion 127 includes a mounting protrusion 129, which is substantially similar to mounting protrusion 128 on finger adapter 120 and is adapted to engage mounting aperture 118. Preferably, grip 122 defines a hollow portion 130 having an opening 132, adapted for holding tool bits holder 124 and finger adapter 120. Grip 122 may further include a cover 134 for covering opening 132.

Tool holder kit 110 allows the user to select between utilizing tool holder 112 with his finger and utilizing tool holder 112 with his hand. Thus, in case where access to the working spot is limited, tool holder 112 may be mounted on a user's finger. Whereas access is not limited, tool holder 112 may be mounted on grip 122 and the user can use his hand. This way, the user may alternate between his finger and grip 122, without searching for the appropriate tool and/or changing the tool bits. It will be appreciated that tool holder kit 110 may further include other tool holders in addition to or instead of tool holder 112, such as a tool holder 60 of FIG. 5*a* or a tool holder 80 of FIG. 6.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A tool holder comprising:

a finger socket for mounting on and enclosing a fingertip of a user, the tool holder being operated by a finger in said finger socket;

a first tool holding portion coupled to said finger socket;

wherein said first tool holding portion is at least partially formed of material having magnetic properties;

a second tool holding portion coupled to said finger socket holding a tool at a different angle relative to the finger socket from said first tool holding portion; and a ratchet mechanism mounted in at least one of said first and second tool holding portions.

2. The tool holder of claim 1, further comprising:

a housing;

said finger socket being coupled to said housing.

3. The tool holder of claim 1, wherein said second tool holding portion includes a magnet.

4. The tool holder of claim 1, wherein each said tool holding portion is integrally formed with said finger socket.

5. The tool holder of claim 2, wherein said housing is integrally formed with said finger socket.

6. The tool holder according to claim 1, wherein said first tool holding portion is perpendicularly mounted on said finger socket and said second tool holding portion is mounted in parallel to said finger socket.

7. The tool holder according to claim 2, wherein said first tool holding portion is perpendicularly mounted on said finger socket and said second tool holding portion is mounted in parallel to said finger socket.

8. The tool holder according to claim 1 wherein said finger socket comprises a slit extending along the length of said finger socket.

9. The tool holder according to claim 1 wherein said finger socket comprises a finger adapter releasably disposed therein.

10. The tool holder according to claim 1 wherein said finger adapter is selected from a plurality of finger adapters each having a different inner diameter.

11. The tool holder according to claim 1 wherein one of said tool holding portions is a wrench holder.

12. The tool holder according to claim 11 wherein said wrench holder is configured to snugly fit a wrench socket selected from a plurality of wrench sockets.

13. The tool holder according to claim 1 wherein one of said tool holding portions is configured for mounting an element holder thereon.

14. The tool holder according to claim 13 wherein one of said tool holding portions further includes a rotator for rotating said element holder.

15. The tool holder according to claim 1 wherein one of said tool holding portions is an accessory holder.

16. A tool holder kit comprising:

a tool holder according to claim 1; and, a grip having a mounting portion for mounting said tool holder.

17. The tool holder according to claim 1, wherein said ratchet mechanism is operated by a single finger in said finger socket.

18. A tool holder comprising:

a finger socket for mounting on and enclosing a fingertip of a user;

a first tool holding portion mounted on said finger socket;

a second tool holding portion coupled to said finger socket holding a tool at a different angle relative to the finger socket from said first tool holding portion; and a magnet and a ratchet mechanism mounted in both said first and second tool holding portions and operated by a single finger in said finger socket.

19. A method for forming a tool holder, the method comprising:

forming a finger socket for mounting on and enclosing a fingertip of a user;

coupling a first tool holding portion to said finger socket;

coupling a second tool holding portion to said finger socket, said second tool holding portion holding a tool at a different angle relative to the finger socket from said first tool holding portion;

forming at least a portion of each said tool holding portion from a material having magnetic properties; and mounting a ratchet mechanism in at least one of said first and second tool holding portions, said ratchet mechanism adapted for operation by a single finger in said finger socket.

* * * * *